United States Patent [19]

Wilkins

[11] Patent Number: 4,771,939

[45] Date of Patent: Sep. 20, 1988

[54] CENTER SPECIAL SLOTTED CONTAINER

[75] Inventor: Joe R. Wilkins, Deerfield, Mich.

[73] Assignee: Nekoosa Packaging Corporation, Toledo, Ohio

[21] Appl. No.: 90,783

[22] Filed: Aug. 28, 1987

[51] Int. Cl.[4] ..... B65D 5/02

[52] U.S. Cl. ..... 229/132; 229/183; 229/900

[58] Field of Search ..... 229/132, 133, 183, 155, 229/DIG. 9, 16 R, 900

[56] References Cited

U.S. PATENT DOCUMENTS

| | | | |
|---|---|---|---|
| 1,030,294 | 6/1912 | Ferres | 229/132 |
| 1,236,444 | 8/1917 | Jones | 493/162 |
| 2,281,304 | 4/1942 | Gillian | 229/132 |
| 2,367,717 | 1/1945 | Davidson | 229/132 |
| 2,521,989 | 9/1950 | McPherson | 229/136 |
| 3,202,339 | 8/1965 | Franklin, Jr. | 229/183 |
| 3,332,602 | 7/1967 | Flax | 229/126 |
| 3,432,086 | 3/1969 | Galloway et al. | 229/126 |
| 3,934,791 | 1/1976 | Dick | 229/37 R |
| 3,952,941 | 4/1976 | Zimmerman | 229/41 B |
| 4,159,076 | 6/1979 | Engdahl | 229/37 R |
| 4,471,902 | 9/1984 | Sraggs | 229/44 R |
| 4,508,258 | 4/1985 | Graser | 229/900 |
| 4,516,717 | 5/1985 | Curran | 229/15 |
| 4,614,297 | 9/1986 | Davis et al. | 229/132 |

*Primary Examiner*—Stephen Marcus
*Assistant Examiner*—Gary E. Elkins
*Attorney, Agent, or Firm*—John R. Nelson

[57] ABSTRACT

A center special slotted container is shown which is manufactured from sheet of corrugated paper material. The blank is formed such that top and bottom flaps provide parallel edges in knock-down manufactured condition when the manufacturer's glue joint is made up. Before the glue joint is firmly set, this knock-down carton is readily processed in a squaring device of a folder-gluer (a Flexo folder-gluer is an example) to prove a quality manufactured carton, and overcome out-of-square defects.

9 Claims, 2 Drawing Sheets

CENTER SPECIAL SLOTTED CONTAINER

BACKGROUND OF THE INVENTION

This invention relates to the field of carton construction. More specifically, it relates to the field of carton constructions for manufacture from corrugated paper and in particular to corrugated cartons of the center slotted container type which employ a center special slotted bottom construction. By "center special slotted container" is meant the blank of the carton is formed with unequal length bottom flaps, the carton blank being folded into a collapsed tube design and glued at the manufacturer's joint. The collapsed tube configuration is also referred to as "knock down assembly". This knock down assembly is fed to a squaring device after processing in the folder gluer machine, whereupon parallel compression edges or plates opposing each other are oscillated against the free edges of the top and bottom flaps of the glued, knock down carton assembly to "square up" the glued manufacturer's joint. At the time the blank enters this squaring device, the glued joint is not fixedly set up, that is, the adhesive is not yet dried. The combined squaring pressure of the oscillating plates and the vertically stacked weight of the succession of tubular collapsed blank delivered from the folder-gluer machine hold the glued joint square long enough for the glued joint to dry and set.

The center special slotted container (sometimes referred to hereinafter as a CSSC box) has heretofore utilized bottom flaps of a configuration such that after the blank is fabricated to a knock down assembly, the bottom flaps provide an uneven edge and upon engagement by the parallel plates of the squaring device may cause, and often does cause, the manufacturer's glue joint to set up in a condition where the joint is skewed. In the industry this condition is a defect called an "out-of-square joint" on the CSSC box. An example of a carton having uneven bottom flaps is U.S. Pat. No. 2,367,717.

It is, accordingly, an object of this invention to provide a center special slotted container which will square up in the automatic folder-gluer machinery for carton set up and will obviate the skewed glued joint in the carton made on such machinery.

It is another object of the present invention to provide an improved rectangular carton construction which includes a novel bottom and top flap configuration for closing the CSSC carton.

And, it is a further object of the present invention to use a die cut section of blank formation in line with the "Flexo" folder-gluer machine enabling formation of the blank and manufacture of the blank on a one pass operation and eliminate a second pass in the operation; the single pass operation still producing squared cartons without defects.

A still further object of the present invention is to provide a CSSC container design with a new and novel flap configuration for bottom flaps or top flaps of the carton or both in which the flaps meet in the center of the length and width, respectively, of the carton, and maintain the carton in a collapsed tubular formation such that the outwardly extending top and bottom flaps that are of the same length; thereby enabling squaring of the manufacturer's joint producing a square carton when set up.

Other objects and advantages of the invention will become apparent from the remaining portion of the specification.

DETAILED DESCRIPTION

Figure 1:
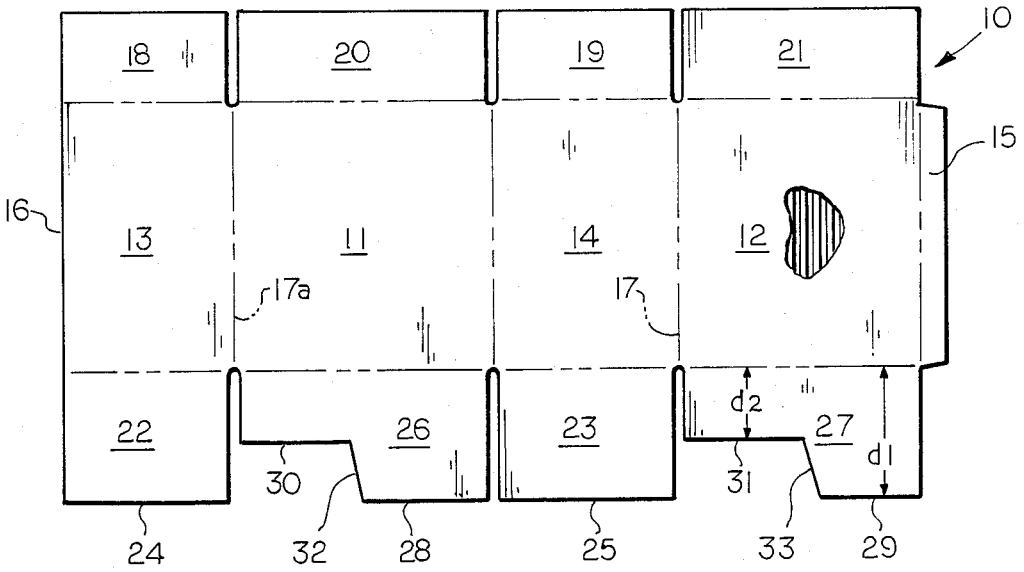
FIG. 1 is a carton construction showing the carton blank according to a first embodiment of the present invention in which the side flaps of the bottom of the carton are of a complementary configuration, as is apparent on FIG. 3.
Figure 2:
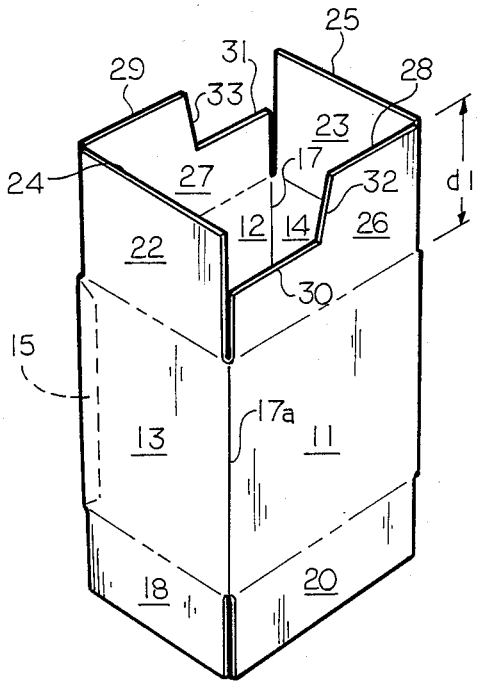
FIG. 2 is a three-quarter side perspective view of the blank of FIG. 1 after it is assembled and glued at the manufacturer's joint showing the carton in inverted position with the bottom flaps uppermost.
Figure 3:
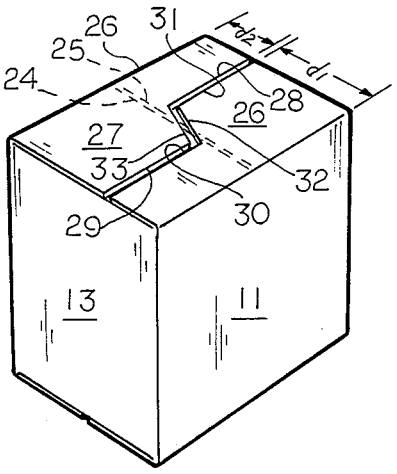
FIG. 3 is a three side perspective view of the carton of FIG. 2 after the bottom flaps and the top flaps of the blank are folded into an assembled, closed carton.

Referring to FIGS. 1–3, the carton blank, indicated generally at 10 according to the first embodiment of the invention, is die cut from corrugated paper or like stock material. Carton blank 10 includes side panels 11 and 12 and end panels 13 and 14. The length dimension of the side panels, measured left to right on FIG. 1 is on the order of $1\frac{1}{2}$ times the width dimension (left to right) of the end panels which provide a blank for a rectangular carton. Depending from the edge of side panel 12 is a glue flap 15 which will overlie and be glued to the end panel 13 along the inside surface at its edge. The blank is folded along the fold lines 17 and 17*a* in the folder-gluer machine and the flap 15 is secured to either the inner or outer surface of the carton.

Conventional RSC Style top flaps 18 through 21 depend from the panels 11 through 14, respectively. The top flaps are proportioned such that they close and cover the rectangular area at the top opening of the carton when folded inwardly along their hinge lines (shown as dashed lines on FIGS. 1 and 2). As an alternate design, the top flaps may be constructed as the bottom flaps to be presently described.

There are bottom flaps depending from the side and end panels on the blank which are hinged at their edges opposite the top flaps. The bottom end flaps 22 and 23 are hinged to depend from end panels 13 and 14, respectively. Flaps 22 and 23 are similarly dimensioned such that their width is substantially that of the width of the end panel to which it is attached and the length, measured in a downwardly extending direction on FIG. 1, is substantially one-half of the length of a side panel (11 or 12). Thus, when bottom end flaps 22 and 23 are folded inwardly to close the bottom of the carton, their edges 24 and 25 meet, or nearly so, at the center of the length dimension of the carton and provide the slotted configuration of that region of the bottom structure (FIG. 3).

The side bottom flaps 26 and 27 depend from the side panels 11 and 12, respectively, along their hinge lines at the bottom perimeter of the side panels.

In the embodiment represented on FIGS. 1–3, the bottom side flaps 26 and 27 have a major length dimension $d_1$ that is the same as the length of the bottom end flaps. The major length $d_1$ extends along a first segment of the flap for approximately onehalf of the span of the bottom flap. After blank 10 is folded over to construct a flattened tubular configuration, (a knock down or "KD" assembly of the carton) flap 15 is glued to end panel 13 adjacent its edge 16, the lower edge 28 of flap 26 and edge 29 of flap 27 will complement each other and provide an approximately continuous bottom edge of the folded KD blank. Bottom side flaps 26 and 27 each have a second segment of lesser length $d_2$ extending from the hinge line to the edge 30 or 31. In the embodiment shown on FIGS. 1–3, the edge of the intermediate segment of the bottom side flap is angled such that the edge 32 on flap 26 is constructed to extend from edge 30, at the minor dimension $d_2$, out to edge 28, at the major dimension $d^1$ of the flap 26. Similarly on flap 27, edge 33 connects the edges 31 and 29. The edges 32 and 33 are dimensioned in placement to be the same and complementary such that bottom side flaps 26 and 27, when folded inwardly as shown in FIG. 3, have their perimeter edges adjacent each other in a slotted offset configuration across the bottom of the container. The design of blank 10 conserves material in a CSSC container. More importantly, the design provides a tubular folded, glued KD carton having its opposite edges at the bottom flap perimeter which lie along a straight edge that is parallel to the straight outside edge of the top flaps providing opposite straight side edges of the KD carton formation. Accordingly, in the squaring device of the folder-gluer machine assembly—a Flexo Folder Gluer machine, for example—the parallel squaring plates contact these straight parallel edges at opposite sides of the carton and adjust any misalignment of the freshly glued joint (flap 15 on panel 13) to assure a squared carton.

After the squaring operation, the folded and glued KD flat formations are fed successively onto a vertical stack. In the stack, the weight of the KD cartons, one on the other, hold the squared configuration of the manufacturer's joint until the glue dries to its final set. Thereafter, the cartons are erected and closed in the fashion illustrated on FIGS. 2 and 3. The flat folded KD carton is opened to the condition shown on FIG. 2. The bottom of the carton is closed by first folding the side flaps 22 and 23 inwardly until their edges 24 and 25 lie adjacent each other along the transverse center of the bottom. These edges may touch or, preferably, be slightly spaced apart from one another (dashed outline on FIG. 3). Next, the bottom side flaps 26 and 27 are folded inwardly such that the edges 28, 33 and 29 on flap 27 lie adjacent and substantially parallel the edges 31, 32 and 29 of flap 26. The folded bottom flaps may be glued or stapled together in the usual fashion to make up the carton bottom. The bottom side flaps have a portion of their free edge disposed along a plane that extends at an angle across the bottom of the assembled carton.

FIG. 3 shows the carton inverted after it is filled and the top and bottom flaps closed.

Figure 4:
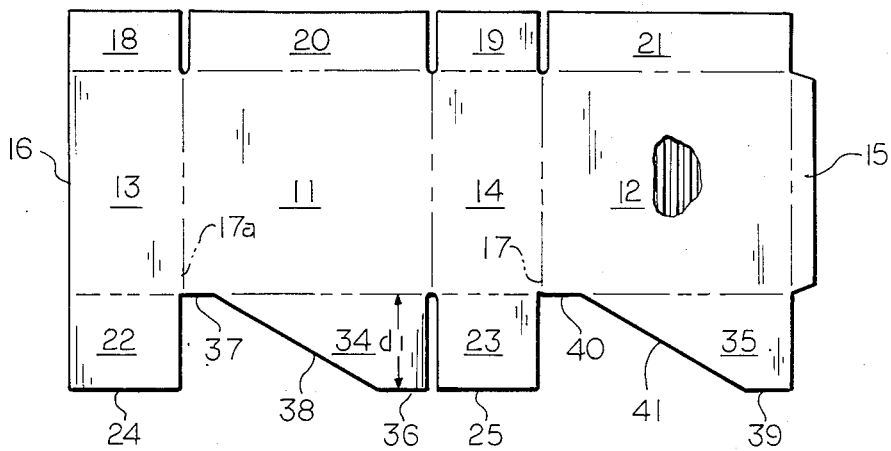
FIG. 4 is a corrugated papaer carton blank according to a second embodiment of the invention in which the side flaps of the bottom of the carton are cut at an angle extending across the width of the carton, as will be apparent on FIG. 6.
Figure 5:
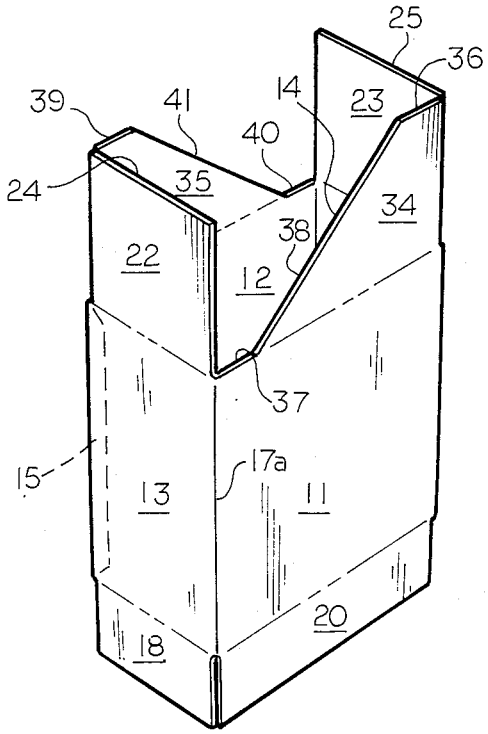
FIG. 5 is a three-quarter side perspective view of the blank of FIG. 4 after it is assembled and glued at the manufacturer's joint the carton being in inverted position with the bottom flaps uppermost.
Figure 6:
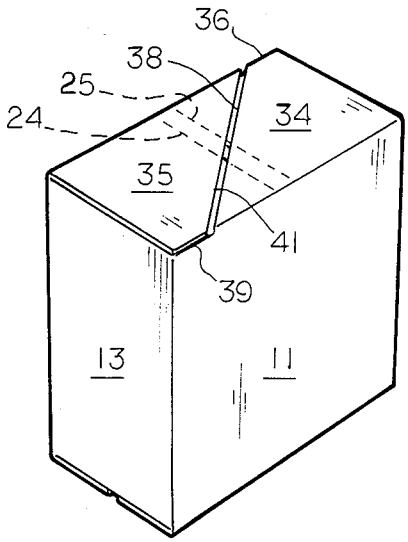
FIG. 6 is a three-quarter side perspective view of the carton of FIG. 5 after the bottom flaps (shown uppermost) and top flaps of the blank are folded into an assembled, closed carton.

On FIGS. 4–6, there is shown a second embodiment of the invention. In this embodiment, the same reference numerals are used in connection with similar parts of the carton. On FIG. 4, the dimensions used are different in the blank to illustrate the versatility of the box design; the box of FIG. 4 being rectangular and of a $2\frac{1}{4}$ to 1 length to width ratio. In this embodiment, the bottom is shown as providing a full angled configuration of the parallel edges 38 and 41 of the bottom side flaps. Bottom side flaps 34 and 35 each have a major dimension $d_1$ that is the same as the length of the bottom end flaps 22 and 23. This dimension is approximately one-half of the lengthwise span of the side panels 11 or 12 of this box design. Side bottom flap 34 includes the outer edge 36 and an inner edge 37 that lies on the hinge line of flap 34. Edges 36 and 37 are parallel and connected by angled edge 38. In a complementary fashion, bottom side flap 35 includes edges 39 and 40 that are parallel and connected by the edge 41 angled across the bottom width of the carton. When the blank is folded flat about hinge line 17 and 17A, the bottom side flaps 34 and 35 lie adjacent each other but are reversed in attitude such that their outer edges 36 and 39 combine with edges 25 and 24 to provide a straight edge parallel to the opposite outer edge of the top flaps. Accordingly, the parallel right angle flat plate surfaces of the squaring device meet these opposed parallel edges of the folded, glued blank squarely. This squaring action sets or adjusts the manufacturer's joint of the carton providing a true assembly of the flat carton form. In the assembled condition at FIG. 6, the free edge of each of the bottom side flaps extend over less than the length of the side panel to which it is hinged and is angled in the respect to the hinge to the side panel. These angled free edges lie parallel and adjacent each other and intersect the bottom center of the carton. They provide an angled, slotted configuration extending at an angle across and through the bottom center of the carton.

In the embodiments described, the bottom flaps of the carton are all the same extreme dimension outwardly of the hinge line at each open end of the manufactured carton. This allows the squaring device to contact all the flap edges and prevents manufacture of a carton that is in out-of-square condition. The bottom flaps on these embodiments may be angled and offset (as illustrated) to the box designer's choice. The slope of the angle in the bottom side flaps may be determined, however, the resulting blank and assembled carton in glued, knock-down configuration should, in both cases, have parallel edges at the opposed perimeter sides, including the top and bottom of the carton.

While there is shown and described embodiments of this invention in some detail, it will be understood that this description and the accompanying drawings are given merely by way of example, and that the invention is to be limited in scope only by the appended claims.

What is claim is:

1. A center special slotted rectangular container being formed from a blank of corrugated paper having two opposite equal end panels, and two opposite equal side panels disposed longitudinally along the blank and having top and bottom edges, and a glue flap depending from a lateral edge of one of the panels at one longitudinal end of the blank adapted for adhesively connecting it to another panel at the opposite longitudinal end of the blank for erecting a rectangular container, the improvement comprising:

a bottom end flap extending laterally outwardly from the bottom edge of each said end panel a distance that is substantially one-half the width of a side panel and hinged at said bottom edge of the respective end panel, a bottom side flap extending laterally outwardly from the bottom edge of each said side panel a major dimension that exceeds one-half the width of said end panel, said side flap being hinged at a line along the bottom edge of the respective side panel, the bottom end and side flaps being substantially equal in their major dimension of outward extension, said opposed bottom end flaps extending near the longitudinal center of the erected container, said bottom side flaps being complementary and equal, each said flap comprising a first right angle segment having an outer edge parallel with said hinge line and a lateral edge extending perpendicular from the hinge line at one end of the side panel to said outer edge to the major dimension, a second right angle segment having an outer edge parallel to said hinge line and a lateral edge extending perpendicular from the hinge line at the outer end of the side panel substantially less than said major dimension, and an intermediate segment having its outer edge disposed angularly with respect to said hinge line and connected to the outer edge of said first and second segments, whereby the outer edges of said side flaps of the erected container are disposed substantially parallel to each other and extend angularly across the bottom of the container through its longitudinal center.

2. The container defined in claim 1 in which the said outer edges of said bottom side flaps lie parallel to each other in a slotted offset configuration extending across the bottom of the container.

3. The container defined by claim 2 in which the length to width ratio of the carton is $1\frac{1}{4}$ to 1.

4. The container defined by claim 1 in which the outer edges of said bottom side flaps extend angularly through the longitudinal center of the bottom of the container.

5. A center special slotted rectangular container being formed from a blank of corrugated paper having two opposite equal end panels, and two opposite equal side panels disposed longitudinally along the blank and having top and bottom edges, and a glue flap depending from the edge of one of the panels at one longitudinal end of the blank adapted for adhesively connecting it to another panel at the opposite longitudinal end of the blank for erecting a rectangular container, the improvement comprising:

a bottom end flap extending laterally outwardly from the bottom edge of each said end panel a distance that is substantially one-half the width of a side panel and hinged along a fold line at said bottom edge of the respective end panel, a bottom side flap depending laterally from each side panel and hinged along a fold line at the side panel bottom edge, said bottom side flap including a right angle segment at one end of the flap extending laterally a distance that exceeds one-half the width of one of the end panels to an outer edge parallel with said fold line, and an adjacent angled segment of diminishing lateral extent defined along its outer edge extending from the outer edge of the right angled segment toward said fold line, said bottom side flaps and bottom end flaps being complementary and equal in their said major lateral extension from their respective fold lines, and the edges of said angled segment of said bottom side flaps of the erected container are substantially parallel and extend angularly across the bottom of the container.

6. The container of claim 5 wherein the outer edge of the angled segment of each said bottom side flaps extends from the outer edge of the right angle segment to the bottom side flap fold line of the side panel.

7. The container defined by claim 6 in which the length to width ratio of the carton is $2\frac{1}{4}$ to 1.

8. The container of claim 5 wherein each bottom side flap includes a second right angle segment at the other end of the flap defining an outer lateral edge extending a distance substantially less than the width of one of the end panels, the outer edge of the angled segment extending between the outer edges of the two right angled segments at opposite ends of said side flap.

9. The container of claim 5 wherein the outer edges of the bottom end flaps are adapted to be spaced from each other and parallel in the bottom of the assembled container, and the outer edges of the bottom side flaps are adapted to be spaced from each other and parallel in the bottom end of the assembled container.

* * * * *

UNITED STATES PATENT AND TRADEMARK OFFICE

CERTIFICATE OF CORRECTION

PATENT NO. : 4,771,939

DATED : Sept. 20, 1988

INVENTOR(S) : Joe R. Wilkins

It is certified that error appears in the above-identified patent and that said Letters Patent is hereby corrected as shown below:

Column 2, line 18, "papaer" should be --paper--.
Column 3, line 8, "onehalf" should be --one-half--.
Column 5 (Claim 3) line 35, "1 1/4" should be --1 3/4--.

Signed and Sealed this

Thirty-first Day of January, 1989

*Attest:*

*Attesting Officer*

DONALD J. QUIGG

*Commissioner of Patents and Trademarks*